US005111726A

United States Patent [19]

Falcon

[11] Patent Number: 5,111,726

[45] Date of Patent: May 12, 1992

[54] DUAL PITCHED MELODEON

[76] Inventor: Randy E. Falcon, 227 Norris Rd., Duson, La. 70529

[21] Appl. No.: 567,680

[22] Filed: Aug. 15, 1990

[51] Int. Cl.[5] ..... G10D 11/00

[52] U.S. Cl. ..... 84/375

[58] Field of Search ..... 84/375, 376 R, 376 EA, 84/376 K, 376 SM, 351, 352, 355, 356, 362, DIG. 15

[56] References Cited

U.S. PATENT DOCUMENTS 2,826,952 3/1958 Giulietti ..... 84/376 R

*Primary Examiner*—L. T. Hix
*Assistant Examiner*—Howard B. Blankenship
*Attorney, Agent, or Firm*—Pravel, Gambrell, Hewitt, Kimball & Krieger

[57] ABSTRACT

The invention relates to reed Melodeons and the improvement thereof by having a multiply pitch option which can be selectively chosen for play with the more modern day music.

12 Claims, 3 Drawing Sheets

DUAL PITCHED MELODEON

BACKGROUND OF THE INVENTION

1. Field Of The Invention

The apparatus of the present invention relates to Accordions. More particularly, the present invention relates to a method of construction for Melodeons that improves the instrument by allowing the instrument to be pitched in either of two keys in place of only one.

2. General Background

The melodeon is a small diatonic accordion initially manufactured in Germany in the second half of the nineteenth century. The instrument is comprised of a right hand (treble) side consisting of a one-row keyboard with ten buttons. Each button controls two notes according to whether the bellows are pushed inward or pulled outward. This system is called "single action". Four stops located on the top of the casing bring into action four banks of reeds in perfect octaves related to each other. On the left hand (bass) side is a keyboard in the form of a hand-grip, with two buttons giving respectively two bass notes and two cords, as well as an air button for the thumb which enables the rapid opening or closing of the bellows during playing.

The original melodeons had the inconvenience of being pitched in A or F keys making them practically impossible to accompany the fiddle. Only in the early 20th century did manufactures produce melodeons pitched in the keys of C or D.

Accordion musicians who use the melodeon extensively in their music, have in recent years started to play more modern music as opposed to traditional tunes played by their ancestors. Today's music requires that more than one pitch be used even in the same song. This often requires the musician to have two or more melodeons on stage, so that he can alternate as the need arises, creating quite an imposition. The musician must remove the neck strap and disconnect the amplifier cord before changing to the alternate instrument. This causes confusion and/or limits the type music to be played.

Although there has been some improvements to reeds and reed blocks used in this type of instrument, little has been done to overcome the problems described above.

Therefore, the principle object of the present invention is to provide for two pitches in a single melodeon;

It is still a further object of the present invention to provide a single melodeon that can be changed from one pitch to another while being played; and It is still a further object of the present invention to provide a single melodeon that produces dry tuning in two pitches.

SUMMARY OF THE PRESENT INVENTION

The system of the present invention solves the shortcomings of the four stop melodeon.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT:

Embodiments of the present invention will now be described with reference to the accompanying drawings.

Figure 3:
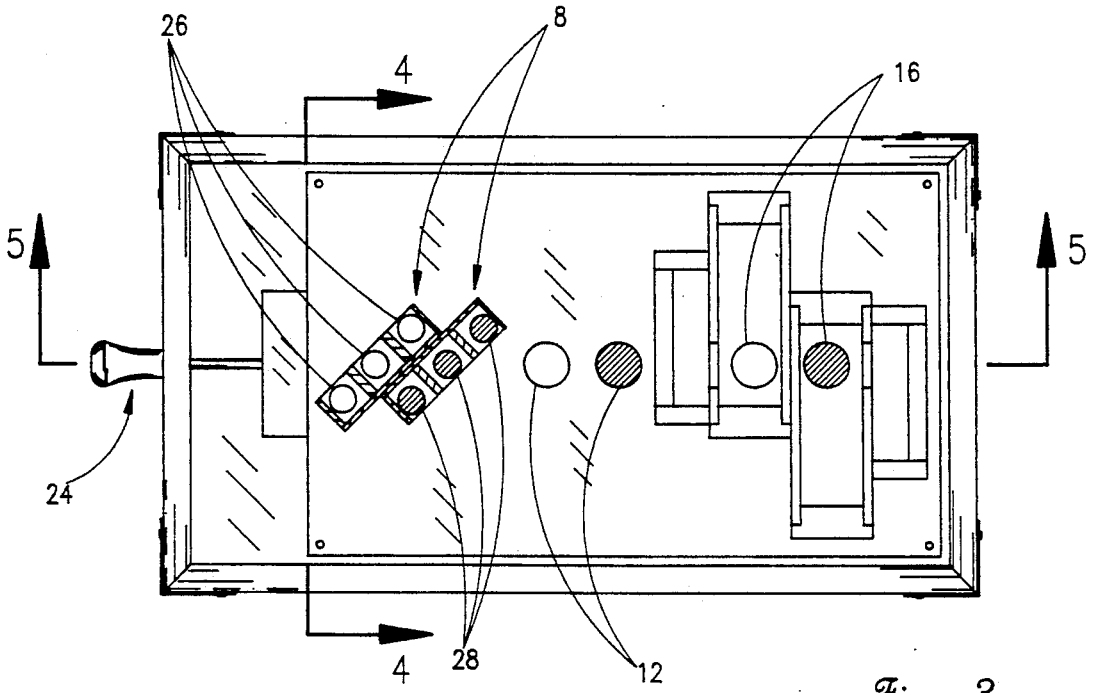
FIG. 3 is a top or plan view of the inside of the base or left hand end box.
Figure 4:
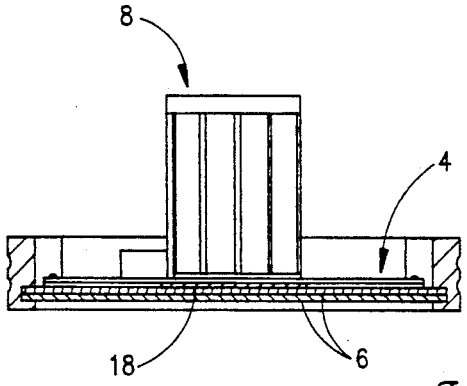
FIG. 4 is a cross-sectional view taken along lines B—B in FIG. 3.
Figure 5:
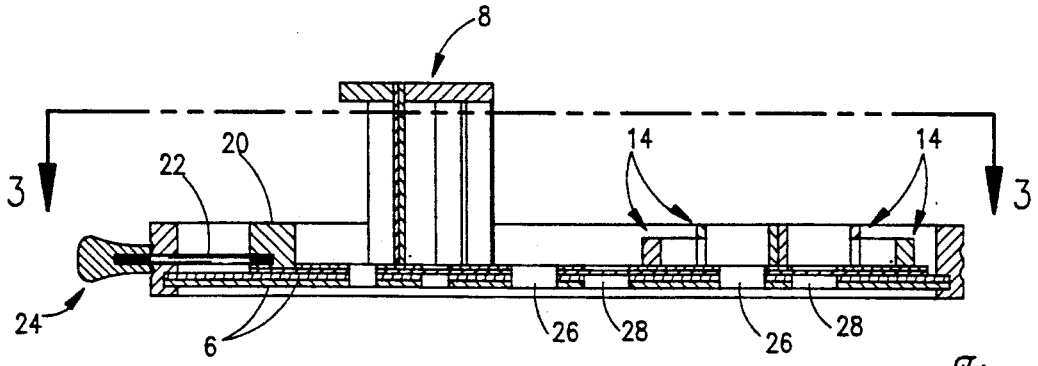
FIG. 5 is a cross-sectional view taken along lines A—A in FIG. 3

Reference is made first to the bass 2, left hand end box shown in FIGS. 3 through 5, wherein the arrangement of the reed blocks are shown mounted on slide plate 4 which is secured to the inner and outer wall plates 6.

The upper bass reed blocks 8, forming the triad harmony of the pitch consist of one reed block of three reeds for each pitch mounted back to back and perpendicular to slide plate 4. Reed blocks 8 are set at an angle and offset either side of the center line so as to maintain a selective alignment between corresponding reed air inlet/outlet holes in inner and outlet wall plates 6 for each pitch.

The lower bass reed blocks 14 required to complete the harmony for each pitch consist of two reed blocks for each pitch and are mounted parallel to slide plate 4. Reed blocks 14 are located on the center line and offset so as to have the larger of the two reed blocks located over the air inlet/outlet holes 16. Notch 18 is provided in the common wall between the two reed blocks comprising each pitch to allow for air from holes 16 to communicate between the two reed blocks 14 for each pitch.

Two larger holes 12 located in slide plate 4 along the center line between the upper and lower reed blocks are provided in slide plate 4 for air inlet/outlet selection by means of the thumb button not shown.

Slide plate 4 is provided with a groove along its length on the side facing inner and outer wall 6 and is fitted with a slide bar 1 that has a set of corresponding holes for one pitch. Slide bar 18 serves as a selector gate for choosing the pitch to be played. Slide bar 18 is attached to slide block 20 which in turn is connected to control rod 22 and selector knob 24. Inner and outer wall plates 6 are drilled with corresponding holes for matching all holes in slide plate 4 for both pitches.

Figure 1:
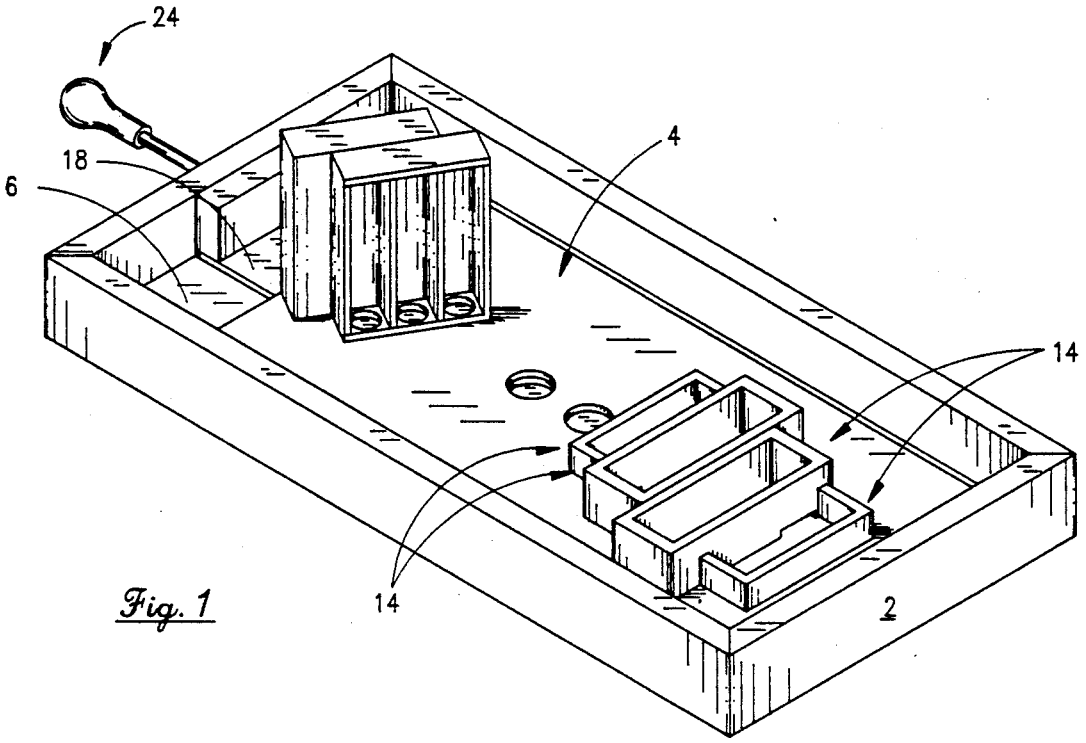
FIG. 1 is an isometric view of the inside of the base or left hand end box of the present invention showing the reed block arrangement.

When the selector knob 24 is in the position shown in FIG. 3, one pitch is selected by opening air outlet holes 26. When knob 24 is pulled out to the position shown in FIG. 1, the opposite pitch can be played by closing holes 26 and opening holes 28. The air inlet button (not shown), when operated allows air to enter through either of air inlet holes 12 regardless of which pitch is chosen.

Figure 2:
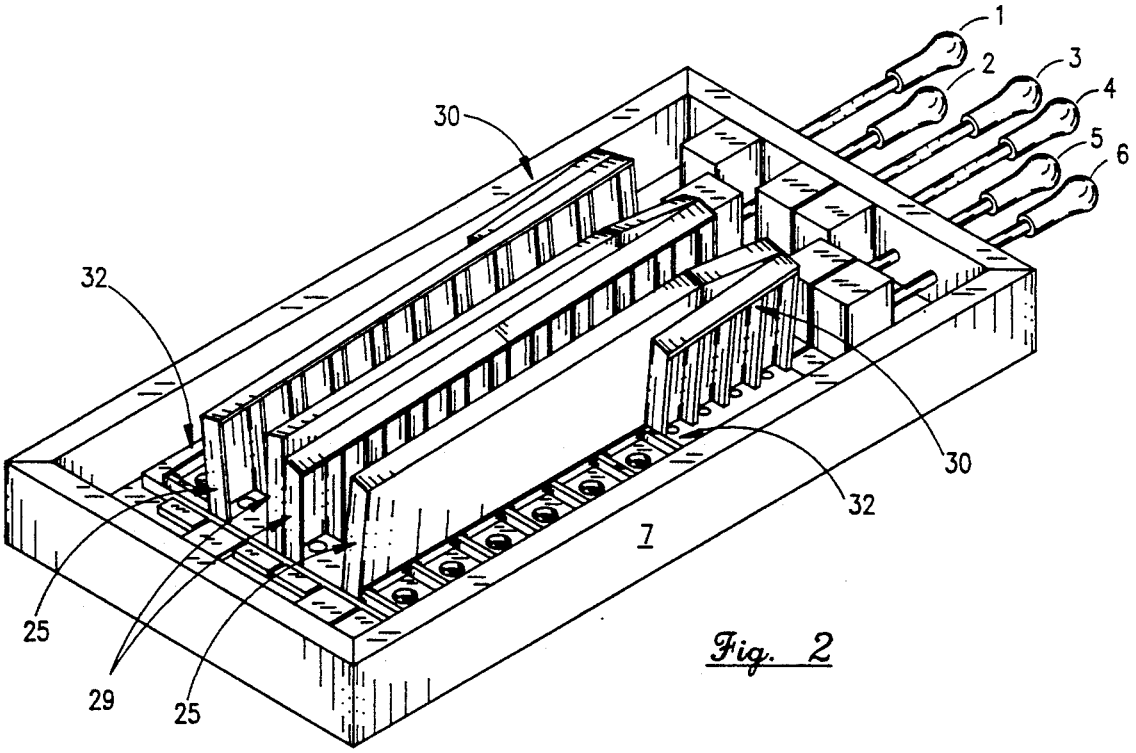
FIG. 2 is an isometric view of the inside of the treble or right hand end box of the present invention showing the reed block arrangement.
Figure 8:
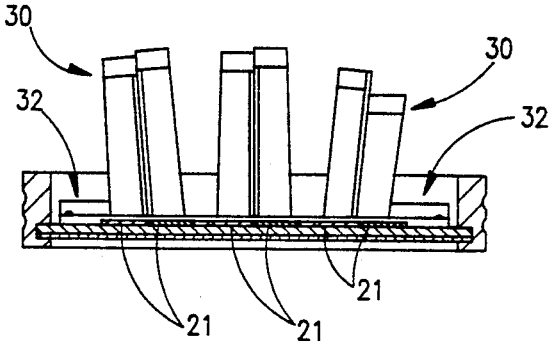
FIG. 8 is a cross-sectional view taken along lines A—A in FIG. 6.

FIG. 2, wherein the internal view of the treble key board box 7 is shown as having six rows of reed blocks, three in one pitch and three of another. There are three basic octaves of sound reed blocks for each pitch, high 29, medium 25, and low 32 and 30. All of the high 29 and medium octave reed blocks 25 are positioned in an essentially upright position as shown in FIG. 8. Whereas, only the first four reed block sections 30 of the low octave rows 30 and 32 are in the essentially upright position while the remaining six reed block sections 32 are in a flat or lying position relative to the upright rows. It has been found that this produces a better tone quality from the smaller reeds of the high octaves. It also provides a clean clear toning pitch by which other instruments tune. Slide plate 5 is provided with a groove along its length on the side facing inner and outer wall 6 and is fitted with six slide bars 21 having a set of corresponding holes for one pitch. Slide bars 21 serve as a selector gates for choosing the pitch to be played. Slide bars 21 are attached to slide blocks 20 which in turn are connected to control rods 22 sand selector knobs 24. Inner and outer wall plates 6 are drilled with corresponding holes for matching all holes in slid plate 5 for both pitches.

Figure 6:
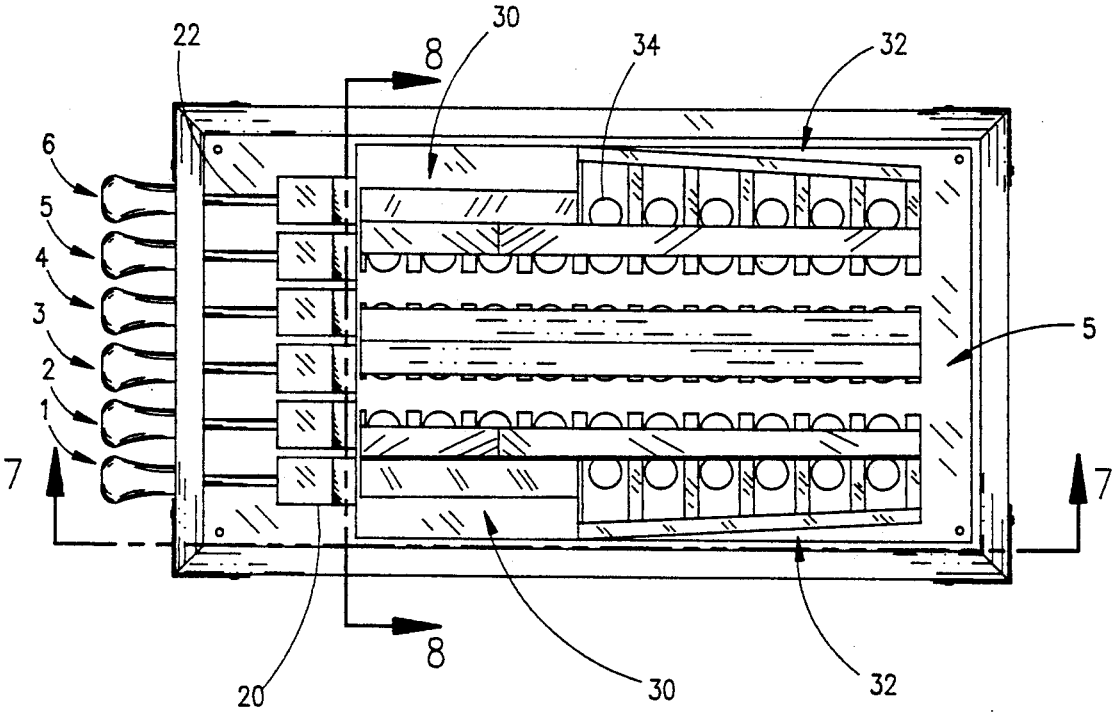
FIG. 6 is a top or plane view of the inside of the treble or right hand end box.
Figure 7:
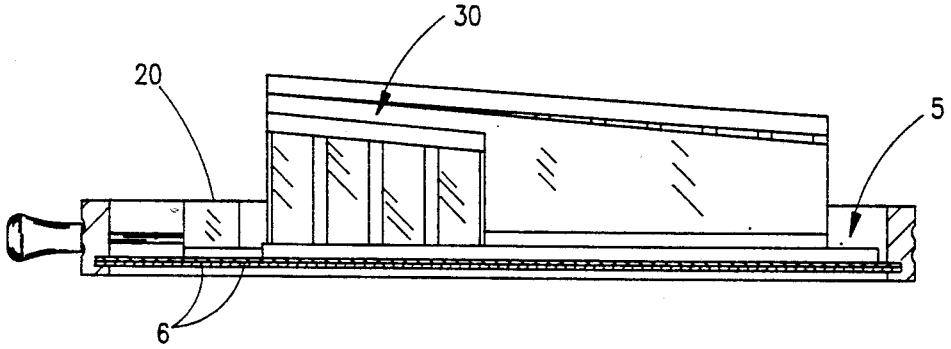
FIG. 7 is a cross-sectional view taken along lines B—B in FIG. 6.

The six stop knobs 24 shown in FIG. 6 located on the upper outer side of the treble keyboard box 7 are connected by rods 22 to wood stop blocks 20 that are in turn connected to slides that open or close air orifices allowing air from the bellows (not shown) to be forced through the diatonic reeds (not shown) mounted on the reed blocks. By closing valve slides 1, 3 and 4 shown in FIG. 2, we see that one pitch may be played with slides 2, 5 and 6 left open. The opposite pitch can be played by reversing the procedure. Note should be taken that only the three slides indicated should be open at any given time to produce a clear single pitch. The arrangement of the reed blocks as indicated herein allow for the use of only three sides per key as opposed to four required by the prior art.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A melodeon having a bellows defining a flexible air chamber with an end box at each end of said air chamber, the improvement comprising:

a) a first end box, comprising 10 treble keys for allowing the induction and expulsion of air and at least two sets of high, medium and low octave treble reeds, one set for each of at least two pitches; and b) a second end box, comprising two bass keys for forming the harmony, one air release key for allowing the rapid intake and release of air and at least two sets of upper and lower harmony reeds, at least one set for each of two pitches.

2. The melodeon of claim 1, wherein said first end box further comprises, six slide stop valves for choosing which of the two treble pitches are to be played.

3. The melodeon of claim 2, wherein said second end box further comprises a single slide stop valve for choosing which of at least two bass pitches are to be played.

4. The melodeon of claim 2, further comprising first four reed block sections of small octaves mounted in an essentially up right position and six reed block sections positioned in a flat or lying position, improving tone quality for the smaller reeds of the small octaves.

5. The melodeon of claim 4, wherein the upper harmony reed sets are mounted in an essentially upright position and the lower harmony reed sets are in a flat or lying position.

6. A melodeon having a bellows defining a flexible air chamber with an end box at each end of said air chamber, the improvement comprising:

a) a first end box, comprising 10 treble keys for allowing the induction and expulsion of air and at least two sets of high, medium and low octave treble reeds, two sets for each of at least two pitches; and b) a second end box, comprising two bass keys for forming the harmony, one air release key for allowing the rapid intake and release of air and at least two sets of upper and lower harmony reeds, at least two sets for each of two pitches.

7. A dual pitch melodeon comprising:

a) a keyboard box, having two different pitch sets of high, medium, and low octave treble reeds mounted thereto;

b) a left hand end box, having two different pitch sets of bass reeds mounted thereto; and c) a bellows, connecting said key board box to said left hand end box.

8. The melodeon of claim 7, wherein said keyboard box further comprises six slide stop valves for selecting one row each of the two sets of high, medium, and low treble reeds for each pitch.

9. The melodeon of claim 8, wherein said left hand end box further comprises a single slide stop valve, for selectively choosing one set of bass reeds for each pitch.

10. The melodeon of claim 9, wherein a portion of the high octave treble reeds are mounted in flat or lying position, relative to the remaining upright high octave reeds, thereby improving tone quality of the high octave reeds.

11. The melodeon of claim 7, wherein the treble reed sets are mounted in an essentially upright position and the bass reed sets are in a flat or lying position.

12. The melodeon having a bellows defining a flexible air chamber with an end box at each end of said air chamber, the improvement comprising:

a) a first end box, comprising 10 treble keys for allowing the induction and expulsion of air and at least two sets of high, medium and low octave treble reeds, two sets for each of at least two pitches; and b) a second end box, comprising two bass keys for forming the harmony, one air release key for allowing the rapid intake and release of air and at least two sets of upper and lower harmony reeds, at least two sets for each of two pitches.

* * * * *